United States Patent [19]

Neilsen

[11] 4,231,624

[45] Nov. 4, 1980

[54] LOCKING ROTARY FILE

[75] Inventor: Hildaur L. Neilsen, Metuchen, N.J.

[73] Assignee: The Rolodex Corporation, Secaucus, N.J.

[21] Appl. No.: 959,176

[22] Filed: Nov. 9, 1978

[51] Int. Cl.[2] ..... B42F 17/00; A47B 49/00

[52] U.S. Cl. ..... 312/186; 40/377; 206/1.5; 220/346; 312/215

[58] Field of Search ..... 312/186, 202, 215, 125, 312/135, 11; 70/63; 206/1.5; 40/377, 493; 220/345, 346

[56] References Cited

U.S. PATENT DOCUMENTS 2,343,280 3/1944 Cory .

2,575,766 11/1951 Olson ..... 312/186

FOREIGN PATENT DOCUMENTS 2356584 6/1974 Fed. Rep. of Germany ..... 312/186

*Primary Examiner*—Alexander Grosz

*Attorney, Agent, or Firm*—Robert E. Burns; Emmanuel J. Lobato; Bruce L. Adams

[57] ABSTRACT

In a rotary file comprising a case open at the top, a card-holding rotor rotatably mounted in the case and a cover rotatable about the axis of the rotor from a closed position to an open position, a lock mounted in a side wall of the case near the back has a locking member which, in locked position, engages a rear portion of the cover when in closed position so as to keep the cover from rotating to open position. When the lock is turned to unlocked position, the locking member is moved clear of the cover so as to allow the cover to open.

4 Claims, 5 Drawing Figures

LOCKING ROTARY FILE

FIELD OF INVENTION

The present invention relates to a rotary file comprising a case open at the top, a card-holding rotor rotatably mounted in the case and a cover which is rotatable about the axis of the rotor from a closed position to an open position. In particular the invention relates to means for locking the case of a rotary file.

BACKGROUND OF THE INVENTION

An enclosed-type rotary file comprises a card-holding rotor rotatably mounted in a case having a bottom and front, back and side walls but open at the top. The rotor is rotatable by means of a knob outside the case and carries a multiplicity of file cards which are selectively exposed to view as a rotor is rotated by means of the knob. A cover having a cylindrical wall and two side walls is mounted in the case for rotation about the axis of the rotor from a closed position in which the cylindrical wall forms a top for the case and an open position in which the cover is received in rear and lower portions of the case so as to leave the top open for exposure of the cards.

In some instances an enclosed-type rotary card file has no means for locking the case. It can hence be opened at will by an authorized or unauthorized person. In other instances a key-operated lock is provided at the front of the case. This leads to certain complications in manufacture since the edge of the cover which is forward when the cover is closed, must be provided with a portion engageable by the lock and the lock must be of special construction so as to engage and secure the cover.

SUMMARY OF THE INVENTION

It is an object of the present invention to provide an improved locking rotary file which overcomes the disadvantages of locking files heretofore known.

In accordance with the invention a lock is provided in a side wall of the file case near the back of the case. The lock comprises a locking member which in locked position engages a rearward portion of the cover when the cover is in closed position so as to block the cover from rotation to open position. When the lock is turned to unlocked position, the locking member is moved clear of the cover so as to permit it to open.

The locking system in accordance with the present invention has the advantages of simplicity, low manufacturing cost and effectiveness. With the lock of the present invention, no special construction of the cover is required.

BRIEF DESCRIPTION OF DRAWINGS

The nature, objects and advantages of the invention will be more fully understood from the following description of a preferred embodiment shown by way of example in the following drawings in which.

DESCRIPTION OF PREFERRED EMBODIMENT

Figure 1:
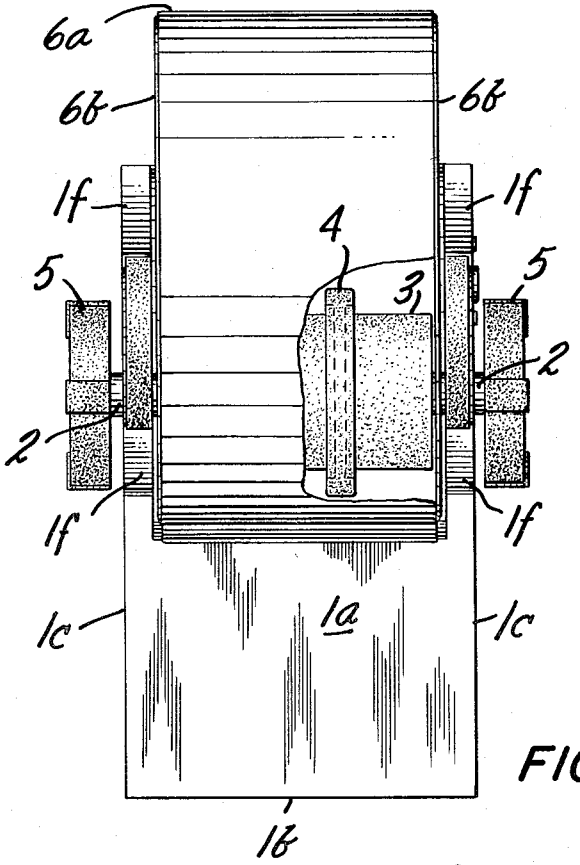
FIG. 1 is a front view of an enclosed-type rotary card file in accordance with the invention shown in closed position.
Figure 2:
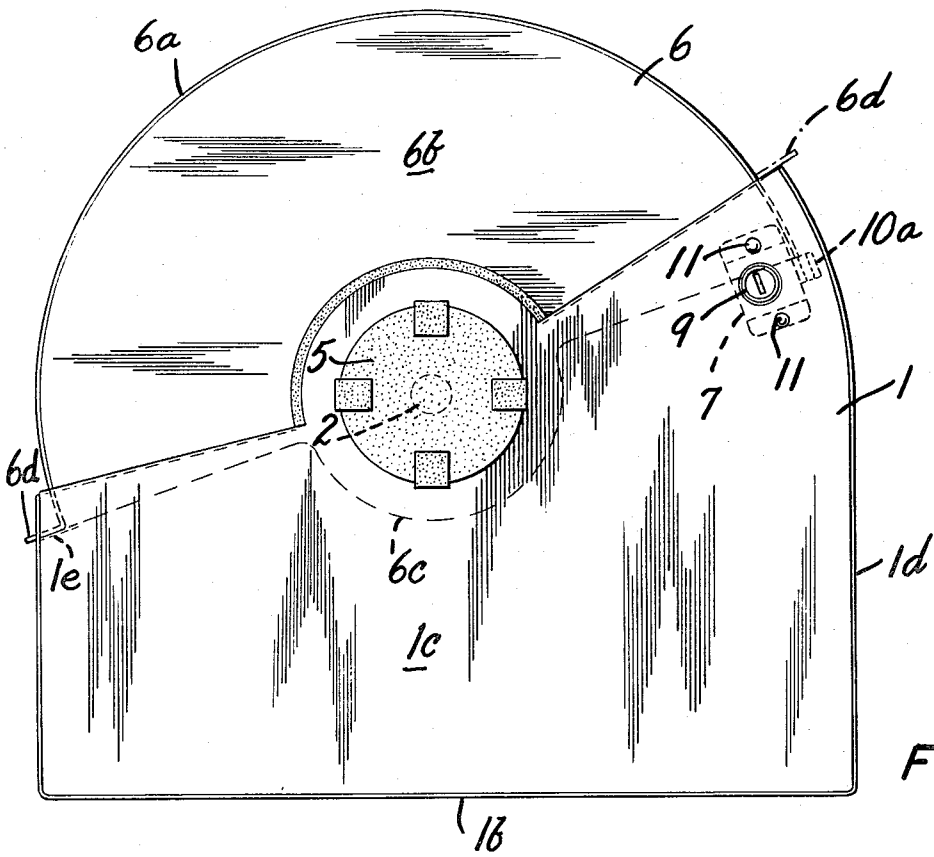
FIG. 2 is a side view of the card file.

The rotary card file shown by way of example in FIGS. 1 and 2 comprises a case having a front wall 1*a*, a bottom 1*b*, opposite side walls 1*c* and a back wall 1*d*. The side walls 1*c* have aligned openings which receive and rotatably support the shaft 2 of a rotor 3 which is disposed inside the case between the side walls and is provided with two circumferentially extending undercut ribs 4 to receive and removably hold a multiplicity of file cards (not shown) provided with notches to receive the ribs 4 of the rotor 3 and thereby retain the cards on the rotor. Knobs 5 are fixed on opposite ends of the shaft 2 outside the case to provide means for manually rotating the rotor so as selectively to expose the file cards to view.

The case 1 is provided with a cover 6 comprising a cylindrical wall 6*a* and opposite side walls 6*b*. The side walls 6*b* are approximately semicircular but have central circular portions 6*c* provided with aligned apertures which receive the shaft 2 so that cover 6 is rotatably about the axis of the rotor 3 between an open position and a closed position. The cylindrical wall 6*a* of the cover is concentric with the axis of the rotor and at its forward edge is provided with an out-turned lip 6*d*. In the closed position of the cover 6, the lip 6*d* rests on an inturned transverse shoulder 1*e* at the front of the case and the cylindrical wall 6*a* and side walls 6*b* of the cover enclose the top of the case. In open position of the cover, the lip 6*d* rests against the upper edge of the inwardly curved rear wall 1*d* of the case as illustrated in broken lines in FIG. 2 and the cover is received in rear and lower portions of the case behind and below the rotor so as to leave the top of the case open to expose to view the cards mounted on the rotor.

The case 1 and cover 6 are conveniently made as sheet metal stampings as illustrated by way of example in the drawings or may be molded of plastic. The rotor 3 together with the shaft 2 and knobs 5 are conveniently molded of plastic material. If the case is made of sheet metal, upper edges of the side walls 1*c* are turned inwardly to form lips 1*f* which extend in almost to the side walls 6*b* of the cover.

Figure 5:
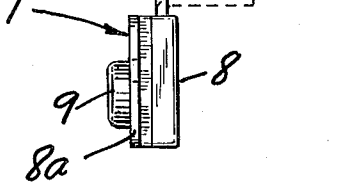
FIGS. 3, 4 and 5 are respectively a top view, front view and side view on a large scale of the lock shown in FIG. 2.
Figure 4:
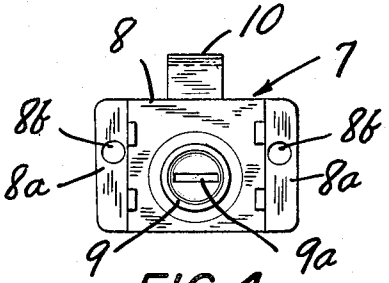
Figure 3:
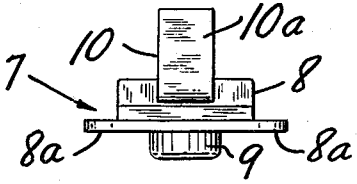

In accordance with the present invention means provided for locking the cover in closed position comprises a lock 7 which is shown on a larger scale—separate from the file case—in FIGS. 3, 4 and 5. The lock 7 is illustrated as comprising a flat case 8 having at its front laterally projecting flanges 8*a* provided with rivet holes 8*b* for mounting the lock in the case as described below. A barrel 9 which is rotatable in the case 8 and has a forward portion projecting forwardly from the case has a flat keyhole 9*a* for the reception of a key by means of which the barrel can be rotated. In accordance with usual construction, the barrel is provided with suitable plungers or other means whereby it can be rotated only with the proper key. An L-shaped locking member 10 extends out through a slot in the top of the case and has a detent portion 10*a* which extends rearwardly from the case approximately perpendicular to the plane defined by the flanges 8*a* as seen in FIG. 5. The barrel 9 is provided in known manner with an eccentric or cam portion which engages the locking member 10 to move it between an unlocked position as shown in solid lines in FIG. 5 and a locked position as shown in broken lines. As locking mechanism of this kind is well known, the interior of the lock 7 is not shown in the drawings. It suffices to say that upon rotation of the barrel 9 by a proper key, the locking member 10 is moved between a locked position and unlocked position as illustrated in FIG. 5.

The lock 7 is mounted on the inner face of one of the side walls 1*c* of the case as illustrated in FIG. 2. A front end portion of the barrel 9 extends out through an opening provided in the side wall and the lock is secured in place by rivets 11 which extend through the holes 8*b* provided in flanges 8*a* of the lock case and through aligned holes in the side wall of the file case 1. As seen in FIG. 2, the lock 7 is mounted on the inner face of an upper rear portion of the side wall 1*c* of the file case and is inclined so that the direction of movement of the locking member 10 is approximately radial with respect to the rotor and the cylindrical wall 6*a* of the cover. Moreover, the lock 7 is positioned so that when the cover 6 is in closed position and the locking member 10 is in locked position (as shown in dotted lines in FIG. 5), the locking member extends beneath a rear portion of the cover and thereby keeps the cover from being opened. When, by rotation of the barrel 9, the locking member 10 is moved to the unlocked position as shown in solid lines in FIG. 5, the projecting portion 10*a* is located rearwardly of the cover as illustrated in dotted lines in FIG. 2 and the cover is hence free to rotate from closed to open position. It will be noted that the lock cooperates with the normal edge of the cover so that no special construction or configuration of the cover is required. Moreover, the lock can be of simple construction and is easily mounted on a side wall of the file card case as illustrated in the drawings. The invention thus provides an extremely simple yet highly effective locking system for an enclosed rotary file.

While a preferred embodiment of the invention has been illustrated in the drawings and is herein particularly described, it will be understood that variations and modifications are possible so that the invention is in no way limited to the illustrated embodiment.

What is claimed is:

1. In a rotary file comprising a case open at the top and having a front wall, side walls and a back wall, a rotor rotatable in said case and comprising a shaft extending through and rotatably supported by said side walls and at least one knob fixed on an end of said shaft externally of said case for turning said rotor, and a cover comprising a cylindrical wall and opposite side walls received inside the walls of said case and rotatable about said shaft for rotation of said cover between a closed position in which said cylindrical wall closes the top of said case and an open position in which said cylindrical wall is received in rear and lower portion of said case, leaving the top of said case open; means for locking said cover in closed position comprising a lock mounted in a side wall of said case and having a rotary barrel rotatable by a key and a locking member inside said case and movable by rotation of said barrel between a locked position in which it engages a side wall of said cover when in closed position to secure said cover from being opened, and an unlocked position in which said locking member is free of said side wall of said cover to permit rotation of said cover from closed to open position.

2. A rotary file according to claim 1, in which said lock comprises a lock housing mounted on the inner face of said side wall of the case and in which said side wall of the case has an opening for insertion of a key into said lock.

3. A rotary file according to claim 2, in which said locking member comprises an L-shaped member projecting from said lock housing with a leg of said locking member perpendicular to said side wall of the case in position to engage a lower edge of said side wall of the cover when said cover is in closed position.

4. A rotary file according to claim 1, in which said lock is located in an upper rear portion of said side wall of the case and said locking member when in locked position is in position to engage a lower edge of said side wall of said cover when in closed position.

* * * * *